US006012617A

United States Patent [19]

Knight et al.

[11] Patent Number: 6,012,617

[45] Date of Patent: Jan. 11, 2000

[54] FLOW CONTROL DEVICE AND A CONTAINER PROVIDED THEREWITH

[76] Inventors: Dudley John Travers Knight, Brackens House, Mill La., Lambourn, Berkshire RG17 8YP, United Kingdom; Luc Van Den Broek, Klaverland 23, Postbus 145, NL-3830 Leusden, Netherlands; Ben Heijenga, Kluppelshuizenweg 34, Postbus 408, NL-7600 Almelo, Netherlands

[21] Appl. No.: 09/068,825

[22] PCT Filed: Nov. 15, 1996

[86] PCT No.: PCT/GB96/02019

§ 371 Date: May 17, 1999

§ 102(e) Date: May 17, 1999

[87] PCT Pub. No.: WO97/18140

PCT Pub. Date: May 22, 1997

[30] Foreign Application Priority Data

Nov. 16, 1995 [GB] United Kingdom ..... 9523359
Jun. 25, 1996 [GB] United Kingdom ..... 9613306

[51] Int. Cl.[7] ..... B67D 3/00

[52] U.S. Cl. ..... 222/481.5; 222/484

[58] Field of Search ..... 222/481.5, 484, 222/566, 545

[56] References Cited

U.S. PATENT DOCUMENTS

| | | | |
|---|---|---|---|
| 1,750,591 | 3/1930 | Hafermann . | |
| 2,335,634 | 11/1943 | Benschoter . | |
| 4,193,524 | 3/1980 | Fleming | 222/484 |
| 4,523,687 | 6/1985 | Hullihen . | |
| 4,802,610 | 2/1989 | Cheek et al. | 222/481.5 |
| 5,628,352 | 5/1997 | Gracyalny et al. | 222/484 |

FOREIGN PATENT DOCUMENTS

| | | |
|---|---|---|
| 4362E | 7/1905 | France . |
| 23 34 060 | 1/1975 | Germany . |
| 694 389A | 7/1953 | United Kingdom . |

*Primary Examiner*—Judy Swayne
*Attorney, Agent, or Firm*—Davis and Bujold

[57] ABSTRACT

A flow control device comprises a body member for mounting the device in a container the body member defining thereon a first location and a second location; a first duct extending through the body member from the first location to the second location, the first duct having a first cross section and a first length; a second air duct extending through the body member from the second location to the first location, the second duct having a second cross section and a second length; characterised in that the cumulative effect of the relationship between the first cross section (D) and first length (L) of the first duct (15), and the second cross section (d) and second length (l) of the second duct (16) being such as to offer: relatively low impedance to flow of liquid along the first duct (15) from the first location to the second location and a consequent flow of air along the second duct (16) from the second location to the first location; and relatively high impedance to flow of liquid along the first duct (15) from the second location to the first location with a consequent flow of air along the second duct (16) from the first location to the second location characterised by the body member (17) having a longitudinal axis (A) and being provided with a barrier (18, 19) extending across the axis (A) to define the first location on one side of the barrier (18, 19) for communication with the interior of a container with which the device is associated and the second location on the other side of the barrier for communication with the exterior of a container as aforesaid; the first duct (22) extending through the barrier (18, 19) and being provided with a flow inlet (24) at the first location and a flow outlet (25) at the second location; the first duct being of relatively uniform cross section so as to present no significant obstruction to flow between the flow inlet (24) and the flow outlet (25); the second duct (23) being provided with an air inlet (27) at the second location and an air outlet (28) at the first location and being of relatively uniform cross section so as to present no significant obstruction to flow between the air inlet (27) and the air outlet (28); the air outlet (28) and the flow outlet (25) lying on the axis (A); the air outlet (28) extending in the direction of the axis A further from the barrier (18, 19) than the flow inlet (24); the flow outlet (25) extending further in the direction of the axis A from the barrier (18, 19) than the air inlet (27). According to further aspects the invention includes a container equipped with the device and a capsule for use in closing the container.

9 Claims, 3 Drawing Sheets

FLOW CONTROL DEVICE AND A CONTAINER PROVIDED THEREWITH

TECHNICAL FIELD

This invention relates to a flow control device and to a container provided therewith. It is particularly concerned with such a device for use with a liquid container such as a bottle.

BACKGROUND ART

In the case of a bottle or other container for a branded liquid product, such as an alcoholic beverage, once the original product has been emptied from the bottle it is known to refill the bottle with a counterfeit beverage and then display the refilled bottle with its original product labels in place but now containing the counterfeit beverage. In locations, such as bars and restaurants, where a branded beverage is dispensed as an individual drink rather than by the bottle it is known that substantial losses are sustained by manufacturers of the branded products by such counterfeiting. A similar problem can arise with other liquids such as oils. Where such counterfeiting occurs, for example, with an engine lubricating oil then use of the counterfeit product under the mistaken impression that it is a genuine one can result in damage to an engine with possible safety hazards.

A number of proposals have been made in the past to make it difficult for a person seeking to counterfeit beverages in this way. UK Patent 694389 (Favre) shows a liquid dispensing closure for the neck of a vessel comprising a stopper arranged to be held against or in the neck of the vessel by a capsule fitting tightly around both the stopper and a part of reduced diameter on the neck, a pair of independent passages of substantially uniform cross section in the material of the stopper, each passage terminating on the bottom of the stopper in independent free communication with the interior of the vessel and near the top of the stopper in independent free access to the outside by way of a common orifice in the side of the capsule, the arrangement being such that when the neck of the vessel is lower than the bottom, one of the passages is in the form of a normal syphon with a priming part reaching from the interior of the vessel to the end of the shorter leg of the syphon while the other passage includes in series from the interior of the vessel an orifice of smaller cross section than the remainder of the passage and an inverted syphon that is, a syphon having the second property hereinbefore described.

U.S. Pat. No. 4,532,687 (Hullihen) describes a non-refillable pour spout for use in the neck of a bottle for permitting liquid to be poured through said spout from within said bottle but resisting replenishment of the liquid of the liquid in said bottle, comprising: a generally cylindrical spout member having a top and bottom and adapted to fit sealingly within the neck of the bottle; a liquid pouring duct extending through said spout body member and including discharge tube means for defining a liquid discharge opening adjacent the top of said spout body member; a first check valve located in said pouring duct in said spout body member, including a first valve seat and a movable first valve closure body held within said spout body upwardly adjacent said first valve seat, said first check valve communicating with said discharge tube means; a second check valve located in said liquid pouring duct in said spout body member, including a second valve seat and a movable second valve closure body held within said spout body upwardly adjacent said second valve seat, said second check valve being located beneath said first check valve and communicating with said first check valve; an air inlet tube attached to said spout body member and having a lower end extending downwardly therebeneath; an air inlet conduit having an open upper end located in said top of said spout body member, said air inlet conduit extending through said spout body member and said air inlet tube, from said top said spout body member to said lower end of said air inlet tube; and a third check valve located in said air inlet conduit, including a valve seat and a movable third valve closure body held within said air inlet conduit and located upwardly adjacent said third valve seat.

DISCLOSURE OF THE INVENTION

According to a first aspect of the present invention there is provided a flow control device comprising a body member for mounting the device in a container the body member defining thereon a first location and a second location; a first duct extending through the body member from the first location to the second location, the first duct having a first cross section and a first length; a second air duct extending through the body member from the second location to the first location, the second duct having a second cross section and a second length; characterised in that the cumulative effect of the relationship between the first cross section (D) and first length (L) of the first duct (15), and the second cross section (d) and second length (1) of the second duct (16) being such as to offer: relatively low impedance to flow of liquid along the first duct (15) from the first location to the second location and a consequent flow of air along the second duct (16) from the second location to the first location; and relatively high impedance to flow of liquid along the first duct (15) from the second location to the first location with a consequent flow of air along the second duct (16) from the first location to the second location characterised by

- the body member (17) having a longitudinal axis (A) and being provided with a barrier (18, 19) extending across the axis (A) to define the first location on one side of the barrier (18, 19) for communication with the interior of a container with which the device is associated and the second location on the other side of the barrier for communication with the exterior of a container as aforesaid;
- the first duct (22) extending through the barrier (18, 19) and being provided with a flow inlet (24) at the first location and a flow outlet (25) at the second location; the first duct being of relatively uniform cross section so as to present no significant obstruction to flow between the flow inlet (24) and the flow outlet (25);
- the second duct (23) being provided with an air inlet (27) at the second location and an air outlet (28) at the first location and being of relatively uniform cross section so as to present no significant obstruction to flow between the air inlet (27) and the air outlet (28);
- the air outlet (28) and the flow outlet (25) lying on the axis (A);
- the air outlet (28) extending in the direction of the axis A further from the barrier (18, 19) than the flow inlet (24);
- the flow outlet (25) extending further in the direction of the axis A from the barrier (18, 19) than the air inlet (27).

According to a first preferred version of the first aspect of the present invention the body member (17) or the barrier (18, 19) serves to locate a baffle (30) in a flow path from the first location to the vicinity of the flow inlet (24) so that liquid from the first location downstream of the baffle (30)

is caused to be deflected by the baffle so as not to enter the flow inlet (24) directly from the flow path.

According to a second preferred version of the first aspect of the present invention or the first preferred version thereof the barrier (18, 19) is in the form of a cup shaped component having a base region (18), wall (19) extending from the base region (18) to provide an internal volume the cup shaped component having an open top (20); a major proportion of the length of the first duct (22) extending through the internal volume.

According to a third preferred version of the present invention or any preceding preferred version thereof body member (17) has an external sleeve (18) comprising one or more deformable members (18A to 19G) located about the axis (A) and adapted to resiliently conform to a port into or out of a container (11) so as to inhibit the passage of liquid or air into or out of the container (11) by way of the port except through their respective first or second ducts (22, 23). Typically the or each deformable member (18A to 18G) comprises an annular ring.

According to a fourth preferred version of the first aspect of the present invention or any preceding preferred version thereof flow the body member (17) or the barrier (18, 19) or an extension thereof serves to locate a pouring lip (20) in a flow path from the flow outlet (25) to the second location. Typically the lip (20) comprises an annular member co-axial with the axis (A).

According to a second aspect of the present invention there is provided a container having a duct through which liquid can be caused to pass into or out of the container characterised by the duct (12) incorporating a flow control device (16) according to the first aspect or any preferred version thereof.

According to a third aspect of the present invention for a container according to the second aspect there is provided a capsule (13) for forming around the container (11) to close off the duct (12) the capsule (13) serving to incorporate the control device (16).

BRIEF DESCRIPTION OF DRAWINGS

An explanation followed by an exemplary embodiment of the invention will now be described with reference to the accompanying drawing of devices for closing a container according to the present invention of which:

FIGURES 1 to 3

Figure 3:
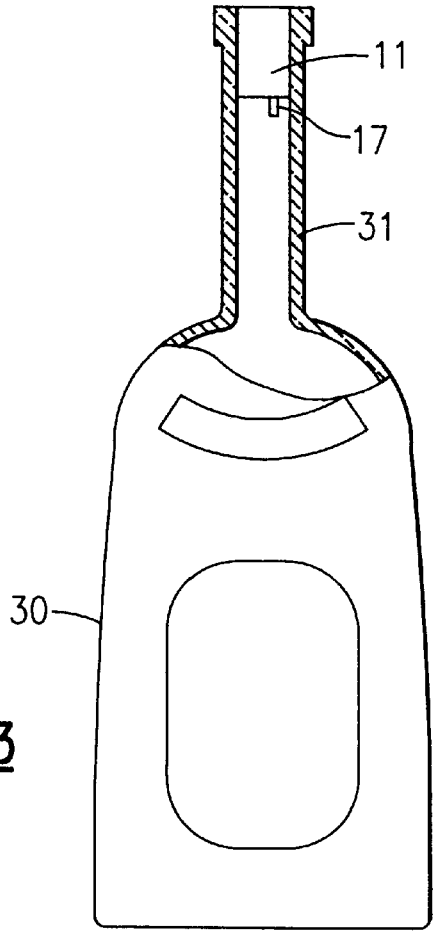
FIG. 3 is a part sectioned elevation of a bottle incorporating the device of FIGS. 1 and 2.

These show Plug 11 is of transparent plastics material with a degree of flexibility and has an inner end 12 and an outer end 13. Cylindrical wall 14 provides for the secure location of the device 11 in the neck of a bottle as shown in FIG. 3.

The plug 11 has extending through it a first duct 15 for liquid and a second duct 16 for air.

First duct 15 is of circular cross section with diameter D and is of length L. The first duct 15 incorporates a change in direction provided by angularity 15A which serve to inhibit attempt to pass a flexible tube through the plug 11.

Second duct 16 is of circular cross section with diameter d and length l. Diameter d of second duct 16 is substantially less than diameter D of first duct 15. Length l of the second duct 16 is longer than length L of first duct 15 since it passes through the main body of plug 11 but also through stub extension 17 integral with plug 11.

Figure 1:
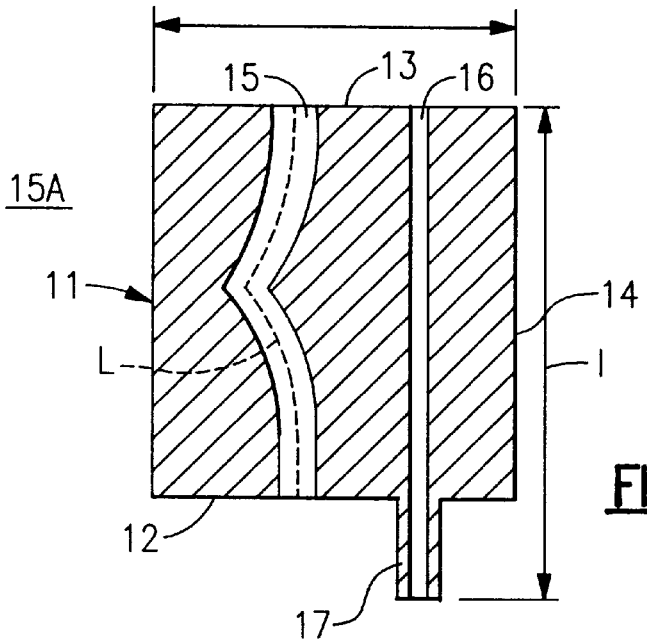
FIG. 1 is a sectional elevation of an explanatory device.
Figure 2:
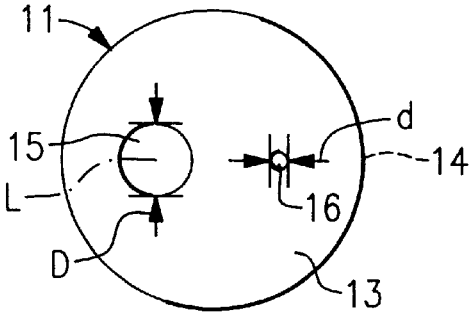
FIG. 2 is a view of the device of FIG. 1 from beneath.

FIG. 3 shows a bottle 30 with neck 31 in which is incorporated plug 11 as described in connection with FIGS. 1 and 2. The bottle 30 contains a liquid beverage 31. To obtain a supply of beverage 31 the bottle is tipped to enable the liquid to flow along neck 31. The liquid enters the plug 11, passes through it by way of first duct 15 and leaves the bottle. The change in liquid volume of beverage 31 in the bottle 30 causes a consequent fall in pressure in the interior of the bottle 30 which is compensated for by an inflow of air into the bottle 30 by way of second duct 16.

The relative sizes of the first duct 15 and the second duct 16 provide for the combination of the two to act as a form of diode to liquid flow. In pouring out liquid 31 from the bottle the combination of the two ducts provides little impedance to flow. It is a widespread illegal practice to attempt to refill a bottle when it has been emptied to a greater or lesser extent of an original authorised content so as to attempt to pass off the refilled liquid as being the same as an original contents. This is particularly widely practised when the original contents of the bottle was an imported expensive spirit such as whisky, gin or brandy and the bottle continues to bear its original label and/or other indicia. One common method of undertaking this form of counterfeiting is to immerse a conventional bottle in a reservoir of unoriginal liquid to enable the bottle to swiftly be refilled and thereafter the bottle is re-used.

By using a bottle equipped with the device of the present invention the diode effect referred to earlier acts to resist the refilling of the bottle. Typically if the bottle is immersed in liquid the relative proportions of the first duct 15 and the second duct 16 act to resist liquid flow through the plug 11 from the outer end 13 to the inner end 12 to a greater extent than was the case with flow in the other direction. It appears that any transfer of liquid into the bottle is initially very slow and soon ceases.

If an attempt is made to insert a tube through the first duct 15 then the discontinuity 15A acts to limit travel or causes the tube to so distort that it cannot readily allow liquid to be entered into the bottle by way of the tube.

In use the plug 11 will be installed in a bottle in the bottling plant serving to fill the bottles. Once inserted the plug 11 is not readily withdrawn.

MODE FOR CARRYING OUT THE INVENTION

This takes the principles described in connection with FIGS. 1 to 3 and embodies them in a practical version.

Figure 4:
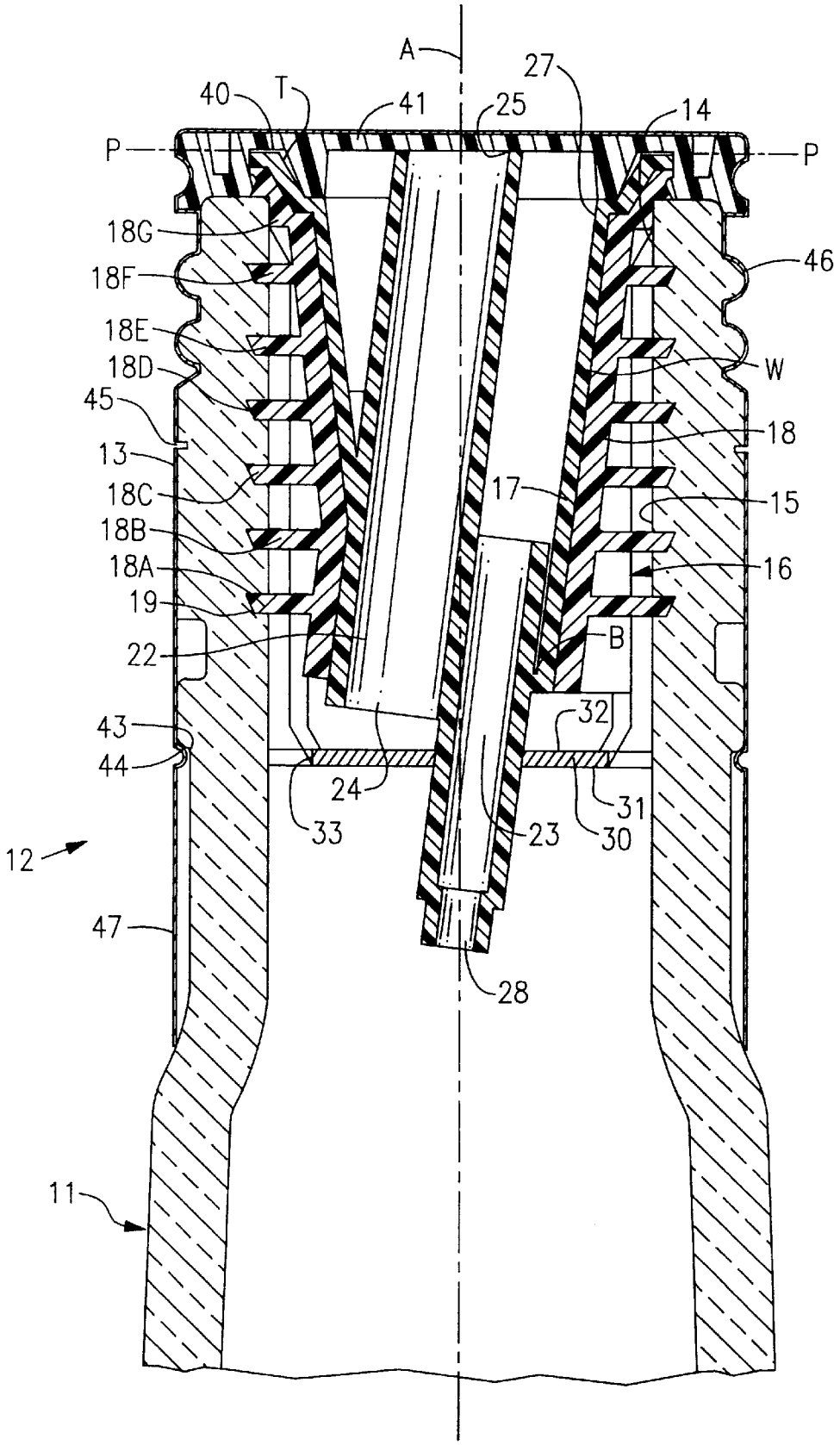
FIG. 4 is a side sectional elevation of an embodiment of the present invention.
Figure 5:
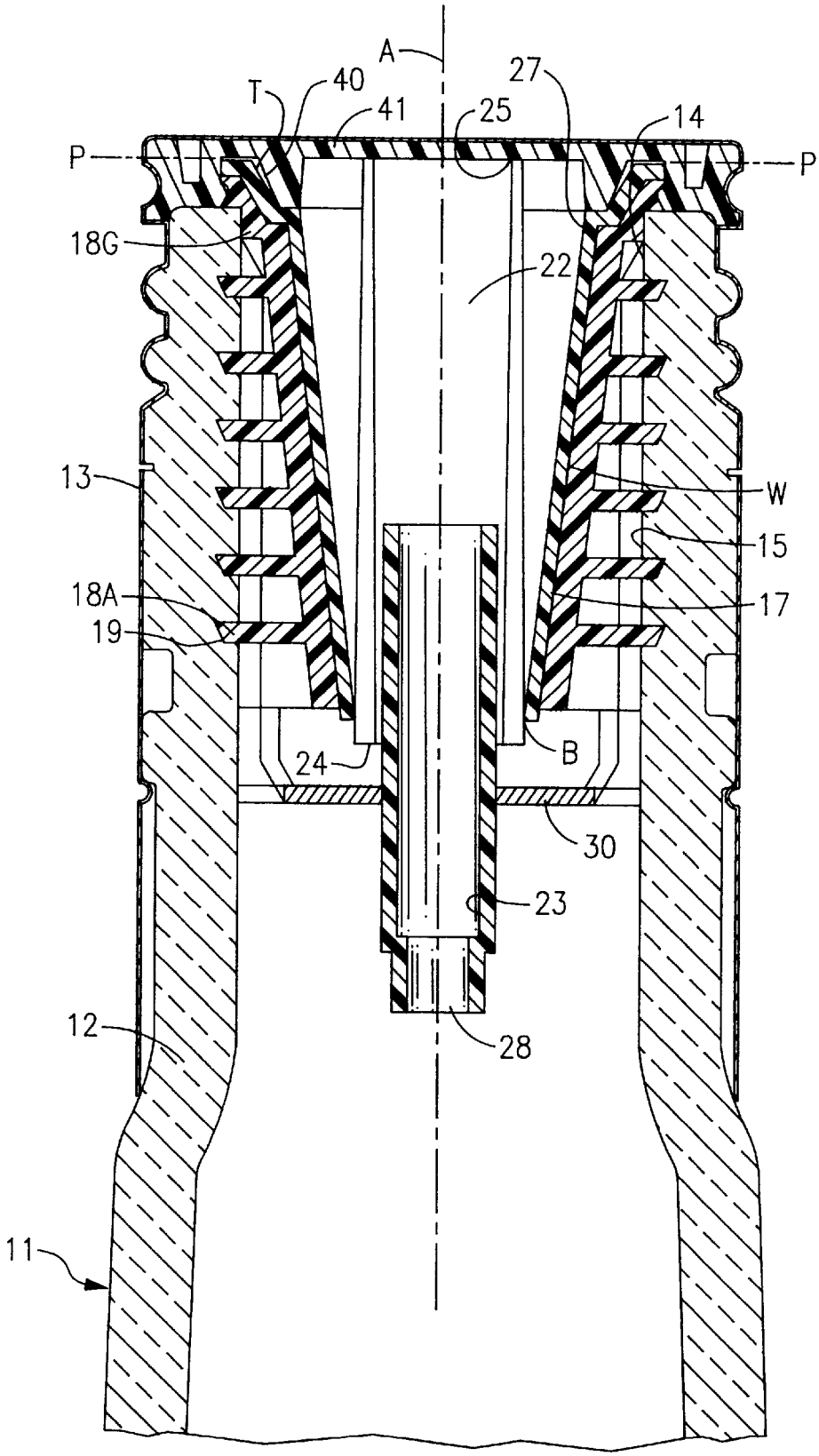
FIG. 5 is a front sectional elevation at right angles to that of FIG. 4.

FIGURES 4 and 5

Part of a bottle 11 containing an alcoholic beverage is shown with a neck 12 shrouded once the bottle 11 has been filled by means of a capsule 13. Normally open end 14 of bore 15 of the neck 12 is shown closed by a flow control device 16. Inspection of a number of current bottle designs suggests that in manufacture bottles external dimensions are held to conform to relatively tight tolerances whilst internal dimensions, typically those of bore 15, are not held to the same tightness of tolerances nor is the bore of regular cylindrical form.

The device 16 is made up of body member 17 with a central longitudinal axis A. The body member 17 incorporates a barrier in the form of a cup with a base B, frusto conical side wall W and an top perimeter T which forms a lip section to facilitate the pouring a controlled stream of beverage from the bottle 11 especially when the bottle is only part filled.

The body member 17 is of relatively rigid plastics material is provided with a sleeve 18 of relatively soft plastics material and incorporates a sequence of integral annular rings 18A to 18G with tapered outer faces (typically outer face 19 of ring 18A) so that the device 16 can be driven into the bore 15 and jammed therein in the axial location shown. The use of a sequence of rings 18A to 18G of flexible plastics material enables the device 16 to be introduced into and then forced down into bore 15 in a readily adapted filling operation. The rings 18A to 18F provide for the device once inserted in the bore to be accommodated in the neck with a bore 15 having a profile varying substantially from cylindrical and without tight tolerancing of the bore being needed. Once inserted the device 16 cannot be removed with virtually destroying it. The device 16 is provided with a first, liquid, duct 22 and a second, air, duct 23.

The first duct 22 extends from flow inlet end 24 within the bottle 11 through the base B of the barrier and up to plane P shared by top perimeter T where the first duct 22 opens to atmosphere by way of flow outlet 25 lying symmetrically transverse axis A.

The second duct 23 extends from air inlet end 27 outside the bottle 11 downwardly through the base 18 of the barrier and opens into the bottle 11 by way of air outlet 28 which lies symmetrically transversely across axis A.

The first duct 22 and the second 23 lie at an angle to axis A to provide for the liquid flow outlet 25 to lie co-axial with, though off-set from, air outlet 28. This has been found to provide for greater control of pouring liquid from the bottle 11.

With the air outlet 28 being further into the bottle 11 than the flow inlet end 24 the outlet lying on the axis A the flow of liquid into inlet 24 and so out of the bottle 11 follows a clearly separated path from air entering the bottle 11 by way of air outlet 28. The control of liquid flow with this configuration is particularly significant when the bottle 11 is on partly filled. In this state when the bottle is tipped the separation of air and liquid flow paths ensures that air/liquid mixing is minimised if not substantially avoided and a steady flow of liquid is achieved promptly. This control is facilitated by the relative disposition of liquid outlet 25 and air inlet 27 outside the bottle as against their other ends within the bottle 11. Thus liquid outlet 25 lies on axis A and air inlet is offset from axis A.

The first duct 22, second duct 23 and body member 17 are formed as an integral unit to facilitate manufacture. Amongst other features the relative dimensions and locations of the ducts 22, 23 provide for controlled flow of liquid from the bottle through the first duct 22 and a flow of air into the bottle to replace the displaced liquid.

A further liquid flow control feature is provided by a baffle 30 located beneath the device 16 when located in the bore 15 as shown. The baffle 30 has lower face 31 directed towards the interior of bottle 11; and upper face 32 directed towards the flow inlet end 24 of the first duct 22. The baffle 30 has outer edge 33 which provides for an annular flow passage between the baffle and the inner wall of the bottle in the vicinity of the device 16. The second duct 23 extends downwardly beneath the baffle 30 so that the baffle 30 is located between air outlet 28 and liquid inlet 24. To facilitate manufacture the second duct 23 is of minimum bore for a short length in the vicinity of the air outlet 28.

In the second configuration shown in FIGS. 4 and 5 the bottle 11 is shown with the device 16 secured in place by the capsule 13 in a known manner. This can be readily achieved in a conventional bottle filling and sealing line by holding the perimeter 20 of the device 16 in a recess 40 in a rigid disc 41 mounted in the capsule 13. The machine in the bottling line whereby the capsule is located on the bottle and compressed around the neck 12 can readily cope with the loading necessary to drive the device 16 home into the neck 12. The neck 12 is configured on its outer surface to receive the capsule and hold it in place against inadvertent axial or rotary displacement. Typically the bottle 12 is provided with a recess 43 into which recessed ring 44 is driven. Region 45 of the capsule provides a deliberately weakened section of the capsule so that when the bottle 12 is to be opened relative twisting of the upper part 46 and lower part 47 of the capsule to be separated allowing for the use of upper part 46 as a screw cap for the bottle when in use. In removing the upper part the disc 41 is separated from the device 16 to leave the rim 20 exposed and allow the ready pouring of a steady flow of liquid from the bottle.

From the point of view of pouring the device 16 provides a number of advantages. In particular liquid is not dispensed from the bottle by way of the device 16 until axis a of the bottle 11 has been tilted from the vertical by about 90 degrees. In addition the baffle 30 limits the ability of the contents of the bottle on being tilted, especially when half full or less, to surge towards and flow directly through liquid flow inlet end 24 of the first duct 22. Any moving liquid hitting the barrier 30 is constrained to flow around it so dissipating kinetic energy.

INDUSTRIAL APPLICABILITY

The invention provides an economical and effective means for resisting counterfeiting of original liquids while being readily installed in a conventional filling plant.

While the exemplary embodiments describes a container in the form of a bottle for a liquid comprising an alcoholic beverage the invention is capable of application towards many types of container apart from bottles, such as cans and containers of metal, plastics material or treated card, and for many types of liquid apart from alcoholic beverages such as non-alcoholic beverages and essences, flavourings liquid foods, oils (both edible and those intended for oils and lubricants for machinery) and additives. The invention provides for a liquid container which while providing for the ready dispensing of the contents resists the refilling of the bottles and in particular resists the ready introduction of bogus liquids. As was pointed out earlier it is a common practice in certain parts of the world to take advantage of brand or other identity on a given bottle by retaining the displayed identity while filling the bottle with a cheap imitation of the original liquid. The present invention provides a device which is cheap to manufacture and readily adopted for existing bottling or container filling processes which provides resists illicit filling. Quite apart from its defensive function the invention also provides a closure through which a liquid can be readily dispensed in a controlled manner from a container equipped with the closure.

We claim:

1. A flow control device comprising a body member for mounting the device in a container the body member defining thereon a first location and a second location; a first duct extending through the body member from the first location to the second location, the first duct having a first cross section and a first length; a second air duct extending through the body member from the second location to the first location, the second duct having a second cross section and a second length; wherein the cumulative effect of the relationship between the first cross section (D) and further length (L) of the first duct (15), and the second cross section (d) and second length (l) of the second duct (16) being such as to offer: relatively low impedance to flow of liquid along the first duct (15) from the first location to the second location and a consequent flow of air along the second duct (16) from the second location to the first location; and relatively high impedance to flow of liquid along the first duct (15) from the second location to the first location with a consequent flow of air along the second duct (16) from the first location to the second location whereby the body member (17) having a longitudinal axis (A) and being provided with a barrier (18, 19) extending across the axis (A) to define the first location on one side of the barrier (18, 19) for communication with the interior of a container with which the device is associated and the second location on the other side of the barrier for communication with the exterior of a container as aforesaid;

the first duct (22) extending through the barrier (18, 19) and being provided with a flow inlet (24) at the first location and a flow outlet (25) at the second location; the first duct being of relatively uniform cross section so as to present no significant obstruction to flow between the flow inlet (24) and the flow outlet (25);

the second duct (23) being provided with an air inlet (27) at the second location and an air outlet (28) at the first location and being of relatively uniform cross section so as to present no significant obstruction to flow between the air inlet (27) and the air outlet (28);

the air outlet (28) and the flow outlet (25) lying on the axis (A);

the air outlet (28) extending the direction of the axis (A) further from the barrier (18, 19) than the flow inlet (24);

the flow outlet (25) extending further in the direction of the axis (A) from the barrier (18, 19) than the air inlet (27).

2. The flow control device as claimed in claim 1 wherein the body member (17) or the barrier (18, 19) serves to locate a baffle (30) in a flow path from the first location to the vicinity of the flow inlet (24) so that liquid from the first location downstream of the baffle (30) is caused to be defected by the baffle so as not to enter the flow inlet (24) directly from the flow path.

3. The flow control device as claimed in claim 1 wherein the barrier (18, 19) is in the form of a cup shaped component having a base region (18), wall (19) extending from the base region (18) to provide an internal volume the cup shaped component having an open top (20); a top proportion of the length of the first duct (22) extending through the internal volume.

4. The flow control device as claimed in claim 1 wherein the body member (17) has an external sleeve (18) comprising one or more deformable members (18A to 19G) located about the axis (A) and adapted to resiliently conform to a port into or out of a container (11) so as to inhibit the passage of liquid or air into or out of the container (11) by way of the port except through their respective first or second ducts (22, 23).

5. The flow control device as claim in claim 4 wherein the or each deformable member (18A to 18G) comprises an annular ring.

6. The flow control device as claimed in claim 1 wherein the body member (17) or the barrier (18, 19, 20) or an extension thereof serves to locate a pouring lip (20) in a flow path from the flow outlet (25) to the second location.

7. The flow control device as claimed in claim 2 wherein the lip (20) comprises an annular member co-axial with the axis (A).

8. The container having a duct through which liquid can be caused to pass into or out of the container wherein the duct (12) incorporating a flow control device (16) as claimed in claim 1.

9. The closure for a container as claimed in claim 8 wherein a capsule (13) for forming around the container (11) to close off the duct, the capsule serving to incorporate the control device (16).

* * * * *